US008661628B2

(12) United States Patent
Keyaki et al.

(10) Patent No.: US 8,661,628 B2
(45) Date of Patent: Mar. 4, 2014

(54) SLIDE FASTENER

(75) Inventors: Keiichi Keyaki, Toyama (JP); Takanori Ozawa, Toyama (JP)

(73) Assignee: YKK Corporation (JP)

( * ) Notice: Subject to any disclaimer, the term of this patent is extended or adjusted under 35 U.S.C. 154(b) by 55 days.

(21) Appl. No.: 13/387,765

(22) PCT Filed: Jul. 30, 2009

(86) PCT No.: PCT/JP2009/063593

§ 371 (c)(1),
(2), (4) Date: Jan. 30, 2012

(87) PCT Pub. No.: WO2011/013232

PCT Pub. Date: Feb. 3, 2011

(65) Prior Publication Data

US 2012/0124788 A1 May 24, 2012

(51) Int. Cl.
*A44B 19/38* (2006.01)

(52) U.S. Cl.
USPC ..... 24/386; 24/433

(58) Field of Classification Search
USPC ..... 24/386–388, 433–436
See application file for complete search history.

(56) References Cited

U.S. PATENT DOCUMENTS 6,195,852 B1 3/2001 Kusayama
7,690,089 B2 * 4/2010 Keyaki et al. ..... 24/386
2002/0050031 A1 * 5/2002 Takasawa et al. ..... 24/433
2005/0193528 A1 * 9/2005 Hamada ..... 24/433
2005/0278904 A1 * 12/2005 Matsumoto et al. ..... 24/433
2006/0282998 A1 * 12/2006 Kusayama et al. ..... 24/434
2008/0092347 A1 * 4/2008 Ogura ..... 24/433
2009/0094805 A1 * 4/2009 Keyaki et al. ..... 24/433

FOREIGN PATENT DOCUMENTS

JP 2000-106917 A1 4/2000
JP 2009-95425 A1 5/2009

OTHER PUBLICATIONS

International Search Report, PCT Application No. PCT/JP09/063593 , mailed Nov. 10, 2009.

* cited by examiner

*Primary Examiner* — Robert J. Sandy
*Assistant Examiner* — James Brittain
(74) *Attorney, Agent, or Firm* — Kilpatrick Townsend & Stockton LLP

(57) ABSTRACT

A slide fastener includes a pair of first and second fastener stringers, a box pin, an insert pin, and a pair of first and second sliders. The box pin has a box pin body, a stopper portion arranged at a front end side of the box pin body, and suppressing portions projected on at least one of upper and lower surfaces of the box pin body to suppress sliding of the second slider. Further, the box pin body has a body region, and a notched region arranged at an element-row-side base end portion and having excluded a side surface portion at a side facing the insert pin. The suppressing portions are projected in only the notched region. With this arrangement, the second slider can be stably held at an insert-pin inserting position, and a subsequent insert operation or extract operation of the insert pin can be smoothly performed.

4 Claims, 11 Drawing Sheets

SLIDE FASTENER

This application is a national stage application of PCT/JP2009/063593, which is incorporated herein by reference.

TECHNICAL FIELD

The invention relates to a slide fastener capable of performing an open/insert operation by having an insert pin provided on one fastener stringer, a box pin provided on the other fastener stringer, and a pair of upper and lower sliders having rear openings arranged opposite to each other.

BACKGROUND ART

Conventionally, to open and close left and right front parts of clothes, a slide fastener including a separable bottom end stop is used in many cases. For example, as a slide fastener mainly used for a long coat and a ski wear, for example, there is known a slide fastener capable of separating left and right rows of elements in an engaged state from not only one end (an upper end) of a fastener chain but also from the other end (a lower end) of the fastener chain, to increase functionability and designability of clothes. The slide fastener capable of separating the rows of elements in the engaged state from both ends is also called a reverse-opening slide fastener.

An example of the reverse-opening slide fastener is disclosed in Japanese Patent Application Laid-Open No. 2009-95425 (Patent Document 1).

As shown in FIGS. 16 and 17, a slide fastener 101 described in Patent Document 1 includes a pair of left and right fastener stringers 102 having rows 103 of elements, a box pin 104 arranged on the right fastener stringer 102, an insert pin 105 arranged on the left fastener stringer 102, and a first slider (a lower slider) 106*a* and a second slider (an upper slider) 106*b* slidably arranged along the rows 103 of elements.

Each of the left and right fastener stringers 102 include fastener tapes 107 having core thread portions 107*a* at opposite tape-side edges, and the rows 103 of elements formed by having a plurality of fastener elements attached to tape-side edge portions (element attachment portions) of the fastener tapes 107 including the core thread portions 107*a*. Stoppers 108 that prevent detachment of the second slider 106*b* are arranged at front ends of the left and right rows 103 of elements.

The box pin 104 is continuously extended from a rear end of the row 103 of elements arranged on the right fastener stringer 102. The box pin 104 includes a box pin body 111 that is fixed to a tape-end edge portion of the right fastener tape 107 including the core thread portion 107*a*, a stopper portion 112 that is arranged at a rear end portion of the box pin body 111 and stops the first slider 106*a* to prevent detachment of the first slider 106*a*, a first locking piece 113 having a triangular shape that is projected from the opposite surface of the insert pin 105 of the box pin body 111, and suppressing portions 114 that is projected on a front surface and a back surface of the base end portion at the row of elements side in the box pin body 111 and suppress sliding of the second slider 106*b*.

According to the slide fastener 101 in Patent Document 1, the suppressing portions 114 are formed as described above. Therefore, when the first slider 106*a* and the second slider 106*b* are lowered to an end position at a box pin 104 side along the rows 103 of elements and are held by the box pin 104, the suppressing portions 114 of the box pin 104 are brought into close contact with an inner surface of a slider body of the second slider 106*b*, and increase frictional force of the second slider 106*b* to the box pin 104.

Therefore, a relative position of the second slider 106*b* is stabilized, and free slide of the second slider 106*b* is suppressed. Effects as explained below are obtained by this configuration.

For example, when the slide fastener 101 that can be reversely opened is used for a long coat or the like, the insert pin 105 and the box pin 104 of the slide fastener 101 are generally arranged at a position of a lower end portion of the front of the long coat. Therefore, when a person who wears the long coat closes the left and right fastener stringers 102, the person first lowers the first and second sliders 106*a*, 106*b* to an end position where the box pin 104 is arranged along the rows 103 of elements. Thereafter, the person inserts the insert pin 105 into an element guiding path of the first and second sliders 106*a*, 106*b*.

At this time, the person reverses directions of the first and second sliders 106*a*, 106*b* by folding back a coattail of the long coat upward, to facilitate operation of inserting the insert pin 105 into the first and second sliders 106*a*, 106*b*. Further, the insert pin 105 is often inserted into the first and second sliders 106*a*, 106*b* in a state that the first and second sliders 106*a*, 106*b* are lifted to a position where the insert operation of the insert pin 105 becomes easy. In this case, a positional relationship of the first and second sliders 106*a*, 106*b* is reversed. Therefore, the insert pin 105 is inserted from lower sides of the first and second sliders 106*a*, 106*b*.

However, when the box pin 104 and the first and second sliders 106*a*, 106*b* are lifted to a position where the insert operation of the insert pin 105 becomes easy as described above, the first slider 106*a* and the second slider 106*b* move downward due to own weight from a box-pin-side end position where the inert pin 105 can be inserted (hereinafter, "insert-pin inserting position") and are deviated when the first slider 106*a* and the second slider 106*b* are not supported with fingers.

When positions of the first and second sliders 106*a*, 106*b* are deviated from normal insert-pin inserting positions, the insert pin 105 is interfered with by the other row 103 of elements and the box pin 104 when inserting the insert pin 105 into the first and second sliders 106*a*, 106*b*, and there is inconvenience that the insert pin 105 cannot be sufficiently inserted to a predetermined position.

To overcome this inconvenience, according to the slide fastener 101 in Patent Document 1, the box pin 104 has the suppressing portions 114 as described above. With this arrangement, the second slider 106*b* is held at a normal insert-pin inserting position by using frictional force between the suppressing portions 114 and the second slider 106*b*, and a relative position of the second slider 106*b* can be stabilized. At the same time, free slide of the second slider 106*b* from the normal insert-pin inserting position can be suppressed.

Therefore, even when the person who wears the long coat lifts the box pin 104 and the first and second sliders 106*a*, 106*b* to a position where the insert operation of the insert pin 105 becomes easy by reversing the box pin 104 and the first and second sliders 106*a*, 106*b* before performing the insert operation of the insert pin 105, deviation of the first and second sliders 106*a*, 106*b* from the normal insert-pin inserting positions can be prevented. Accordingly, thereafter, when inserting the insert pin 105 into the first and second sliders 106*a*, 106*b*, the insert operation of the insert pin 105 can be performed smoothly.

CITED DOCUMENT

Patent Document

Patent Document 1: Japanese Patent Application Laid-Open No. 2009-95425

SUMMARY OF THE INVENTION

Problems to be Solved by the Invention

According to the slide fastener 101 described in Patent Document 1, when the box pin 104 and the insert pin 105 are made of metal such as a copper alloy and an aluminum alloy, for example, the box pin 104 and the insert pin 105 are fixed to the fastener tapes 107 by fastening a box pin member made of metal formed in a predetermined shape to side edges of the fastener tapes 107. However, the box pin 104 and the like that are fixed by fastening as described above do not have high size precision, and for example, a variation sometimes occurs in a size of the box pin 104 in a tape front-to-back direction.

When manufacturing the first and second sliders 106*a*, 106*b* that are used for the slide fastener 101, a slider body having upper and lower wing plates and the like is manufactured by die-cast molding a metal material such as an aluminum alloy and a zinc alloy. In this case, at a cooling time after the die-cast molding, a size of each portion of the slider body sometimes changes due to thermal contraction of a metal.

A tab attaching post to attach a tab is sometimes integrally molded with the slider body made of metal that is obtained by die-cast molding as described above. In this case, the slider is assembled by elastically deforming the tab attaching post in a state that the tab is held by the tab attaching post of the slider body.

On the other hand, for example, when a tab attaching member (sometimes called a cover member) that becomes the tab attaching post is molded separately from the slider body made of metal, the slider is assembled by fastening the tab attaching member to the slider body in a state that the tab is held by the tab attaching member.

However, when the slider is assembled by elastically deforming the tab attaching post or when the slider is assembled by fastening the tab attaching member as described above, the upper wing plate of the slider body are sometimes elastically deformed by receiving stress in elastically deforming the tab attaching post or in fastening the tab attaching member. Therefore, the assembled slider does not have high size precision either. For example, a variation sometimes occurs in an interval between the upper and lower wing plates of the slider body (a size in a vertical direction of the element guiding path).

For example, when a variation occurs in a size of the box pin 104 (particularly, a size of the box pin 104 in a tape front-to-back direction) and a size of the second slider 106*b* (particularly, an interval between the upper and lower wing plates of the slider body) as described above, the suppressing portions 114 provided on the box pin 104 sometimes do not effectively work.

For example, if a size in the tape front-to-back direction between crest portions of the suppressing portions 114 projected on the upper and lower surfaces of the box pin 104 becomes too large as compared with the interval between the upper and lower wing plates of the first slider 106*a* or the second slider 106*b*, slide resistance of the first slider 106*a* or the second slider 106*b* suddenly increases and slidability and operability of the slider reduces, when the suppressing portions 114 of the box pin 104 enters the element guiding path of the first slider 106*a* or the second slider 106*b*.

On the other hand, if a size in the tape front-to-back direction between the crest portions of the suppressing portions 114 projected on the upper and lower surfaces of the box pin 104 becomes smaller than the interval between the upper and lower wing plates of the second slider 106*b*, frictional force between the suppressing portion 114 of the box pin 104 and the second slider 106*b* cannot be sufficiently obtained, and the second slider 106*b* cannot be stably held at the insert-pin inserting position.

The invention has been achieved in view of the above conventional problems, and an object of the invention is to provide a slide fastener capable of stably holding sliders at insert-pin inserting positions and capable of smoothly performing an insert operation or an extract operation of an insert pin, without reducing slidability and operability of sliders, even when a variation occurs in a size of a box pin or the sliders.

Means for Solving the Problems

To achieve the above object, the slide fastener provided by the invention is a slide fastener that can perform an open/insert operation, and has a most important characteristic in that the slide fastener includes, as a basic configuration, a pair of first and second fastener stringers having rows of elements at opposite tape-side edge portions of left and right fastener tapes, a box pin extended from an end of the row of elements of the first fastener stringer, an insert pin extended from an end of the row of elements of the second fastener stringer, and a pair of first and second sliders slidably arranged along the rows of elements. The first slider is arranged closer to the box pin than the second slider in a direction to which rear openings of the first and second sliders face each other. The box pin has a box pin body fixed to the fastener tapes, a stopper portion arranged at a front end side of the box pin body and for stopping the first slider, and suppressing portions projected on at least one of upper and lower surfaces of the box pin body and for suppressing slide of the second slider in close contact with an inner surface of a slider body of the second slider to suppress sliding of the second slider. The box pin body has a body region that is formed to surround upper and lower surfaces of a tape-side end edge of the fastener tapes and a side surface at a side opposite to the insert pin, and a notched region arranged at an element-row-side base end portion and having excluded a side surface portion of the box pin body at a side facing the insert pin. The suppressing portions are projected in only the notched region of the box pin body.

According to the slide fastener of the invention, the suppressing portions preferably have a crest portion having a largest height of project from an upper surface or a lower surface of the box pin body, and an inclined portion or a curved portion for gradually reducing the height of project from the crest portion in a tape length direction.

According to the slide fastener of the invention, the box pin body preferably has slits formed in a tape length direction along the suppressing portions at a tape inner side than the suppressing portions.

Further, the box pin preferably has ridge portions projected on at least one of upper and lower surfaces of the box pin body and in close contact with an inner surface of the slider body of the first slider, at a position closer to a front end side of the box pin than the suppressing portions.

Effect of the Invention

According to the slide fastener of the invention, a box pin arranged on a first fastener stringer has a box pin body fixed to fastener tapes, a stopper portion arranged at a front end side of the box pin body, and suppressing portions projected on at least one of upper and lower surfaces of the box pin body and for suppressing slide of the second slider. The box pin body has a body region that is formed to surround upper and lower surfaces of a tape-side end edge of the fastener tapes and a side surface at a side opposite to the insert pin, and a notched region arranged at an element-row-side base end portion and having excluded a side surface portion of the box pin body at a side facing the insert pin. The suppressing portions are projected in only the notched region of the box pin body.

By configuring the slide fastener according to the invention in this way, the suppressing portions can be displaced in a vertical direction by easily elastically deforming the notched region of the box pin body in a vertical direction. Therefore, even when a variation occurs in a size of the box pin or the sliders, for example, and when a size in a tape front-to-back direction between the crests of the suppressing portions projected on the upper and lower surfaces of the box pin becomes larger than the interval between the upper and lower wing plates of the sliders, the suppressing portions of the box pin can be easily displaced to a fastener tape side when the suppressing portions enter the element guiding path of the sliders. Therefore, reduction of slidability and operability of sliders due to excessive frictional force working between the suppressing portions of the box pin and the sliders can be prevented.

On the other hand, when a size in a tape front-to-back direction between the crests of the suppressing portions projected on the upper and lower surfaces of the box pin is set larger than the interval between the upper and lower wing plates in advance by considering size precision and the like of the box pin and the sliders, for example, it is possible to prevent a size between the crests of the ridge portions projected on the upper and lower surfaces of the box pin from becoming smaller than the interval between the upper and lower wing plates of the sliders, even when a variation occurs in a size of the box pin and the sliders.

Therefore, when the second slider moves to the insert-pin inserting position, proper frictional force between the suppressing portions and the second slider can be securely generated by using elastic force and the like of the notched region of the box pin body. Because the box pin can stably hold the second slider at the insert-pin inserting position by this arrangement, a subsequent insert operation of the insert pin into the first and second sliders or extract operation of extracting the insert pin from the first and second sliders can be performed smoothly.

Further, according to the slide fastener of the invention, the suppressing portions can be configured to have a crest portion having a largest height of projection from the upper surface or the lower surface of the box pin body, and an inclined portion or a curved portion gradually reducing the height of projection from the crest portion to a tape length direction.

By configuring the slide fastener as described above, when the first slider is slid for example, interference of the suppressing portions with the upper and lower wing plates of the first slider can be suppressed, and the first slider can be smoothly slid when entering the suppressing portions into the element guiding path from a shoulder opening or a rear opening of the first slider. Further, when entering the suppressing portions into the element guiding path from a rear opening of the second slider, interference of the suppressing portions with the upper and lower wing plates of the second slider can be also suppressed, and the second slider can be smoothly slid.

Further, according to the slide fastener of the invention, the box pin body can be configured to have slits formed in a tape length direction along the suppressing portions at an inner side than the suppressing portions. By providing this configuration, the suppressing portions can be formed to be more easily displaced, and reduction of slidability and operability of the sliders can be more securely prevented.

Further, according to the slide fastener of the invention, the box pin can be configured to have the ridge portions projected on at least one of the upper and lower surfaces of the box pin body for sliding the first slider in close contact with the inner surface of the slider body of the first slider, at a position closer to a front end side of the box pin than the suppressing portions. By configuring the slide fastener in this way, the first slider that moved to the insert-pin inserting position can be stably held by the ridge portions. Therefore, an insert operation and an extract operation of the insert pin can be performed more smoothly.

DETAILED DESCRIPTION OF THE INVENTION

Embodiments of the invention are explained in detail with the specific examples with reference to drawings. The invention is not limited to embodiments explained below, and various modifications are possible when the modified embodiments have substantially the same configurations and also have similar work effects.

For example, the following embodiments are explained for a case where a box pin is arranged at a rear end side of a right fastener stringer, and an insert pin is arranged at a rear end side of a left fastener stringer. However, the invention is not limited to this case, and can be similarly applied to a case where an insert pin is arranged on the right fastener stringer, a box pin is arranged on the left fastener stringer, and a box pin and an insert pin are arranged at a front end side of the fastener stringer.

First Embodiment

Figure 1:
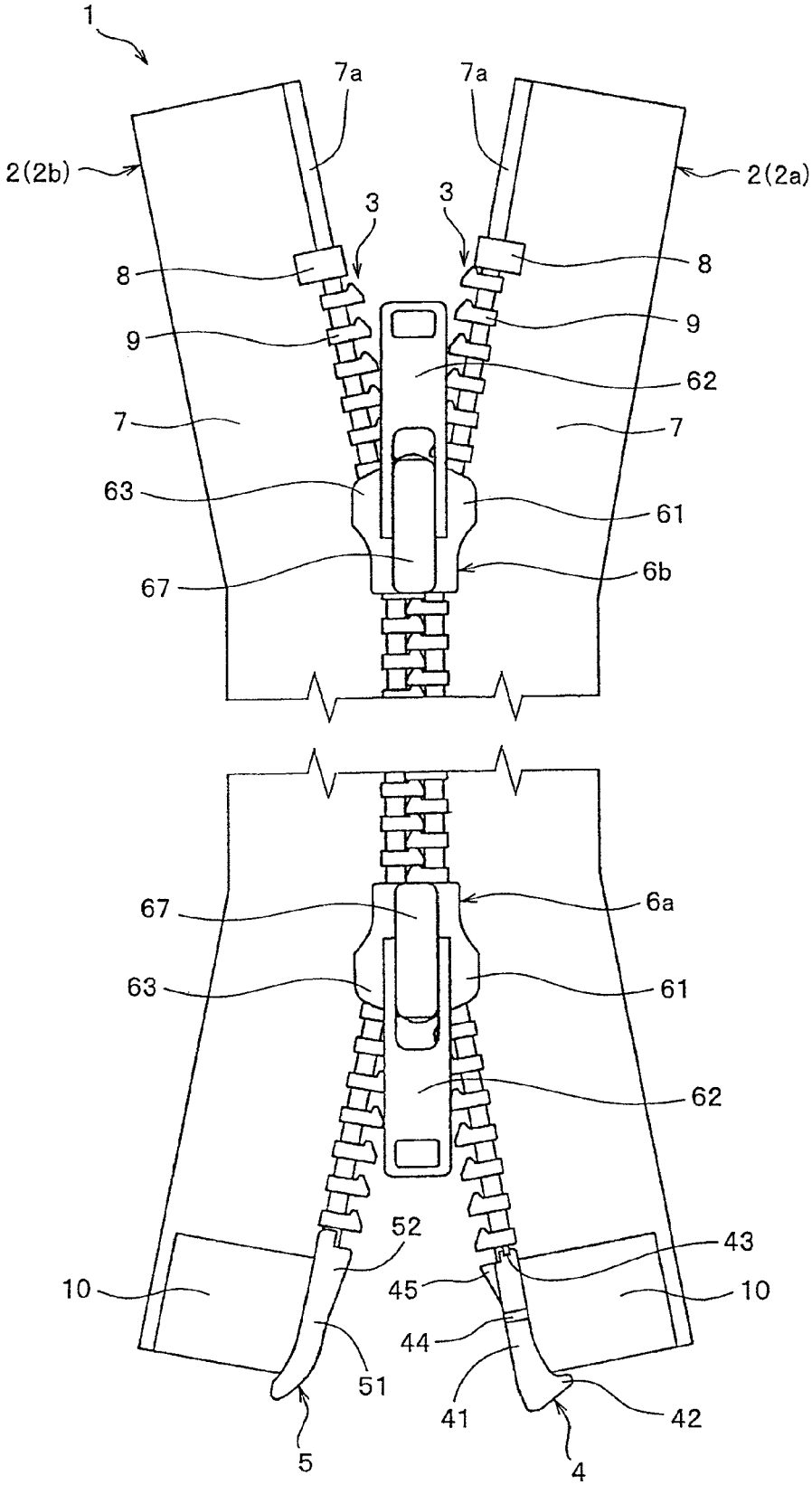
FIG. 1 is a partly-omitted front view of a slide fastener according to a first embodiment of the invention.
Figure 2:
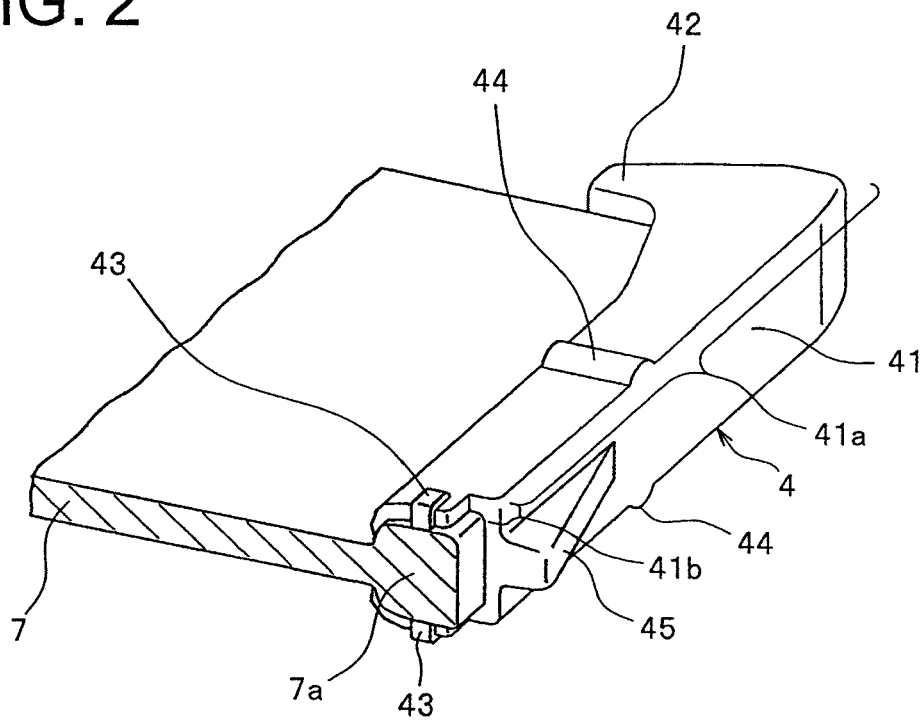
FIG. 2 is a perspective view of a box pin according to the first embodiment.

FIG. 1 is a partly-omitted front view of a slide fastener according to a first embodiment. FIG. 2 is a perspective view of a box pin held by the slide fastener.

Figure 3:
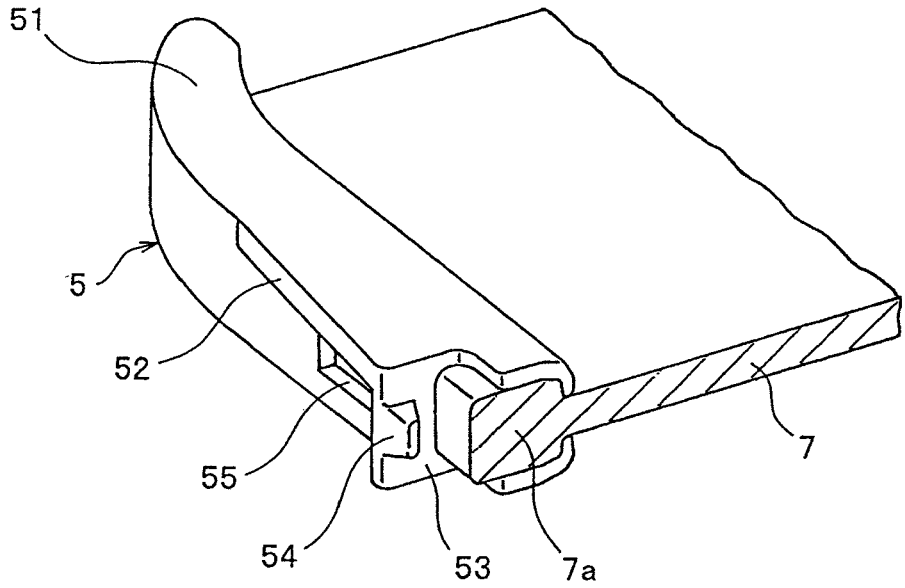
FIG. 3 is a perspective view of an insert pin according to the first embodiment.

FIG. 3 is a perspective view of an insert pin held by the slide fastener.

In the following explanation, a longitudinal direction indicates a longer direction of a fastener tape of a slide fastener. A side where a stopper 8 is arranged on a row 3 of elements is a front side, and a side where a box pin 4 and an insert pin 5 are arranged is an rear side. A horizontal direction indicates a tape width direction of a fastener tape. When the slide fastener is looked at from the front (a surface side) a left side is to the left, and a right side is to the right respectively. A vertical direction indicates a front-to-back direction of a tape orthogonal with a tape surface of a fastener tape. A side where an upper wing plate of a slider is arranged is an upper side, and a side where a lower wing plate of the slider is arranged is a lower side, relative to a fastener tape.

A slide fastener 1 according to the first embodiment includes a pair of left and right fastener stringers 2 on which rows 3 of elements are arranged, a box pin 4 provided continuously from an end of the row 3 of elements of a right fastener stringer 2*a* (a first fastener stringer), an insert pin 5 provided continuously from a rear end of the row 3 of elements of a left fastener stringer 2*b* (a second fastener stringer), and a pair of first and second sliders 6*a*, 6*b* slidably arranged along the rows 3 of elements.

The first slider 6*a* is a reverse-opening slider (which is called a lower slider) arranged at a box pin 4 side, and the second slider 6*b* is a slider (which is called an upper slider) arranged at a stopper 8 side described later.

The left and right fastener stringers 2 have fastener tapes 7 made of fiber, rows 3 of elements arranged at tape-side edge portions of the fastener tapes 7, and stoppers 8 fixed to front ends of the rows 3 of elements, respectively. In this case, each of the left and right fastener tapes 7 have core thread portions 7*a* at opposite tape-side end edges.

The rows 3 of elements are formed attached with a plurality of fastener elements 9 at a constant interval, along the tape-side edge portions (element attaching portions) of the fastener tapes 7 including the core thread portions 7*a*. Further, reinforcing portions 10 are formed on front and back surfaces of rear end portions of the fastener tapes 7 by adhering a film made of resin.

Each of the fastener elements 9 constituting the rows 3 of elements have leg portions fixed to the fastener tapes 7, and coupling heads extended from the leg portions toward outside of the tape. The fastener elements 9 are made of a metal such as a copper alloy and an aluminum alloy, for example, and are formed by fastening a Y-shaped element having a predetermined shape to the fastener tapes 7. In the invention, mode and material of the rows of elements are not particularly limited, and can be arbitrarily changed.

A box pin 4 arranged on a right fastener stringer 2*a* and an insert pin 5 arranged on a left fastener stringer 2*b* are fixed to the fastener tapes 7, by fastening a box pin member and an insert pin member of predetermined shapes made of metal such as a copper alloy and an aluminum alloy.

As shown in FIG. 2, the box pin 4 has a box pin body 41 fixed to the tape-side edge portion of the right fastener tape 7 including the core thread portion 7*a*, a stopper portion 42 of a hook shape arranged at a rear end side of the box pin body 41, suppressing portions 43 and ridge portions 44 projected on upper and lower surfaces of the box pin body 41, and a first locking piece 45 projected in a triangular shape from a side surface at a side opposite to the insert pin of the box pin body 41.

The box pin body 41 of the box pin 4 has a body region 41*a* that is formed to surround upper and lower surfaces of a tape-side end edge of the fastener tapes 7 and a side surface at a side opposite to the insert pin, and a notched region 41*b* arranged at an element-row-side base end portion and having excluded a side surface portion of the box pin body 41 at a side facing the insert pin.

That is, the body region 41*a* of the box pin body 41 has the upper surface portion, the lower surface portion, and the side surface portion at the insert-pin opposite side. The notched region 41*b* has only an upper surface portion and a lower surface portion, and is not provided with a side surface portion at the insert-pin opposite side. Therefore, in the notched region 41*b* of the box pin body 41, a side surface side of the core thread portion 7*a* of the fastener tapes 7 is exposed. The upper surface portion and the lower surface portion of the box pin body 41 include a curved portion hung up by a step portion formed at a tape inside of the core thread portion 7*a* of the fastener tapes 7.

Figure 4:
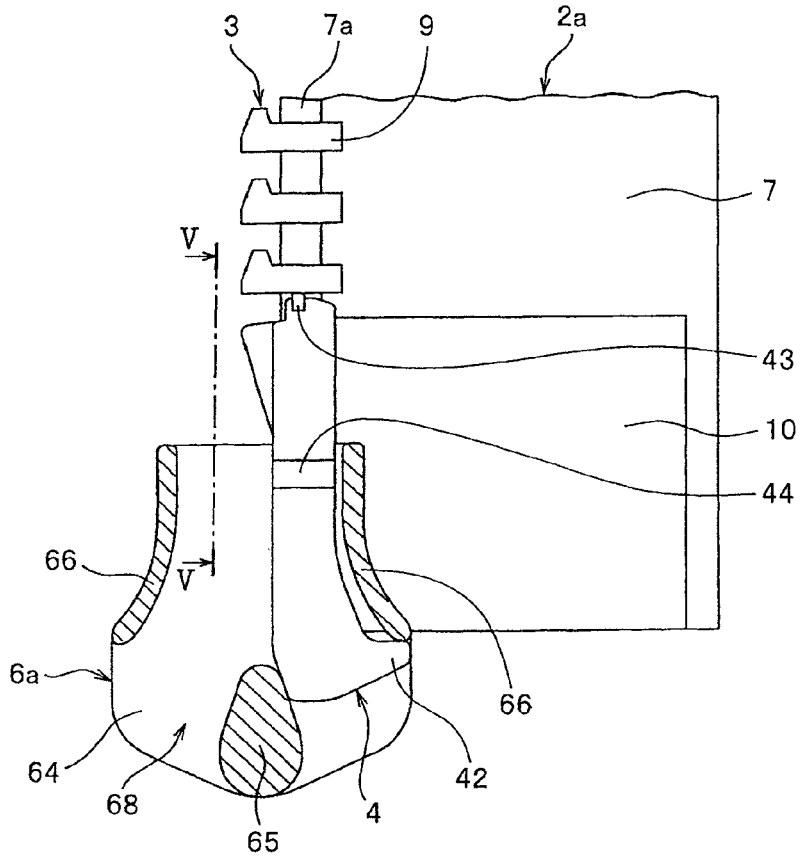
FIG. 4 is an explanatory diagram of a state that a first slider is held at a normal insert-pin inserting position.

The stopper portion 42 of the box pin 4 is formed in a hook shape curved toward a tape inside from the box pin body 41, and has a function of stopping a first slider 6*a* at the insert-pin inserting position by colliding into the first slider 6*a* that slides on the row 3 of elements (see FIG. 4).

The suppressing portions 43 of the box pin 4 are projected on the upper surface portion and the lower surface portion within the notched region 41*b* of the box pin body 41. The suppressing portion 43 formed at an upper surface side and the suppressing portion 43 formed at a lower surface side are symmetrically formed centering the fastener tapes 7.

In this case, the upper surface portion and the lower surface portion in the notched region 41*b* of the box pin body 41 are easily curved in a vertical direction based on of elastic deformation. Therefore, the suppressing portions 43 can be relatively easily displaced in a vertical direction (particularly, to a fastener tape 7 side). The suppressing portions 43 arranged on the upper and lower surfaces are also extended to a front-end surface side of the box pin body 41, and are arranged in contact with the fastener element 9 arranged in the row 3 of elements closest to a box pin 4 side (hereinafter, this fastener element 9 is first fastener element 9).

Further, the suppressing portions 43 have a crest portion 43*a* having a largest height of projection from upper and lower surfaces of the box pin body 41, and a curved portion 43*b* gradually reducing the height of projection in a tape length direction from the crest portion 43*a*. In this case, a size in a vertical direction from the crest portion 43*a* of the suppressing portion 43 formed on the upper surface of the box pin body 41 to the crest portion 43*a* of the suppressing portion 43 formed on the lower surface of the box pin body 41 is set slightly larger than a distance between an inner surface (a plane portion 69*a*) of an upper wing plate 63 and an inner surface (the plane portion 69*a*) of a lower wing plate 64 described later of first and second sliders 6*a*, 6*b*.

The ridge portions 44 of the box pin 4 are formed throughout a tape width direction of the box pin body 41, on the upper surface portion and the lower surface portion of the body region 41*a* of the box pin body 41. The ridge portions 44 are provided at positions where the ridge portions 44 are brought into close contact with a chamfered portion 69*b* described later of the first slider 6*a*, when the first slider 6*a* is stopped at the stopper portion 42.

The ridge portions 44 have a crest portion having a largest height of projection from the upper and lower surfaces of the box pin body 41, and a curved portion gradually reducing the height of projection from the crest portion toward an element-row-side base end portion of the box pin body 41 and a front end portion of the box pin. The ridge portions have a semi-circular shape when looked at in a cross-sectional view along a tape length direction.

In this case, a size from the crest portion of the ridge portion 44 formed at an upper surface side of the box pin body 41 to the crest portion of the ridge portion 44 formed at a lower surface side of the box pin body 41 is set slightly larger than a distance between an inner surface of the upper wing plate 63 and an inner surface of the lower wing plate 64 described later of the first slider 6*a*.

Although the suppressing portions 43 and the ridge portions 44 according to the first embodiment are provided on the upper and lower surfaces of the box pin body 41, in the invention, it can be arranged such that the suppressing portions 43 and the ridge portions 44 are formed on only the upper surface or on only the lower surface of the box pin body 41. In this case, in the box pin 4, a size in a vertical direction from the crest portion of the suppressing portion 43 to an opposite-side surface of the box pin body 41 (a surface on which the suppressing portions 43 are not formed) and a size in a vertical direction from the crest portion of the ridge portion 44 to an opposite-side surface of the box pin body 41 (a surface on which the ridge portions 44 are not formed) are set larger than a distance between the inner surface of the upper wing plate 63 and the inner surface of the lower wing plate 64 of the first slider 6*a*.

The first locking piece 45 of the box pin 4 is formed to project from the side surface at the insert-pin opposite side toward the insert pin 5, at an intermediate portion in a vertical direction of the box pin body 41, at a front portion side of the body region 41*a* of the box pin body 41. A front end surface parallel with the tape width direction is provided at a front end of the first locking piece 45. A front end surface of the first locking piece 45 and a notched surface (a rear end surface) of the notched region 41*b* of the box pin body 41 are formed on the same plane.

The insert pin 5 arranged on the left fastener stringer 2*b* includes an insert pin body 51 fixed to a tape edge portion of the left fastener tape 7 including the core thread portion 7*a*, a guiding piece 52 extended to a box pin 4 side in parallel with an upper surface of the insert pin body 51, a second locking piece 53 in a plate shape extended from the front end portion of the insert pin body 51 to the box pin 4 side and integrally formed with a front end of the guiding piece 52, and a projecting portion 54 projected to the front surface side of the second locking piece 53 and engaged with the fastener element 9 arranged on the right fastener stringer closest to a box pin 4 side. On the surface of the insert pin body 51 facing the box pin, an escape trench 55 is formed to avoid interference of the first locking piece 45 of the box pin 4 with the insert pin body 51 when the insert pin 5 is inserted into the first and second sliders 6*a*, 6*b* as described later.

The first and second sliders 6*a*, 6*b* have a slider body 61 and a tab 62 made of metal such as an aluminum alloy and a zinc alloy, respectively. The slider body 61 has the upper and lower wing plates 63, 64, a coupling post 65 coupling the upper and lower wing plates 63, 64 with an end portion of the slider, flanges 66 provided at left and right side edges of the upper and lower wing plates 63, 64, and a tab attaching post 67 erected on a front surface (an upper surface) of the upper wing plate 63. The tab 62 is rotatably attached to the tab attaching post 67.

Shoulder openings are formed on the slider body 61 at left and right of an end portion where the coupling post 65 is arranged, and rear openings are formed at an opposite end portion. An approximately Y-shaped element guiding path 68 is provided in the slider body 61 communicating through the left and right shoulder openings and the rear openings.

Further, the plane portion 69*a* that forms a constant plate thickness of the upper and lower wing plates 63, 64, and the chamfered portion 69*b* gradually reducing the plate thicknesses of the upper and lower wing plates 63, 64 toward the rear openings are formed on inner surfaces (wall surfaces at an element guiding path 68 side) of the upper wing plate 63 and the lower wing plate 64. The slide fastener 1 of the first embodiment has the first and second sliders 6*a*, 6*b* arranged such that mutual rear openings face each other.

The first and second sliders 6*a*, 6*b* are manufactured by using a method similar to a conventional method. Specifically, first, the slider body 61 in a state that the tab attaching post 67 is not arranged is manufactured by die-cast molding. At the same time, a tab attaching member (not shown) constituting the tab attaching post 67 is manufactured by press molding.

Next, the tab attaching post 67 is formed by fastening the tab attaching member (not shown) to the slider body 61 in a state that the tab 62 is held in the tab attaching member. As a result, the first and second sliders 6*a*, 6*b* that have the tab 62 attached to the tab attaching post 67 of the slider body 61 are assembled.

In the first embodiment, a case where the box pin 4, the insert pin 5, the first slider 6*a*, and the second slider 6*b* are all formed by metal is explained. However, materials of the box pin, the insert pin, the first slider, and the second slider are not particularly limited in the invention.

For example, the box pin and the insert pin can be also formed by injection-molding a thermoplastic synthetic resin such as polyamide, polyacetal, polypropylene to the fastener tapes. Further, the first and second sliders can be manufactured by forming parts such as the slider body, the tab, the tab attaching member by injection-molding a thermoplastic resin, and then by assembling the parts obtained.

Next, for the slide fastener 1 of the first embodiment having the above configuration, operation when closing the left and right fastener stringers 2 from a state that the fastener stringers 2 are opened is explained.

First, the first slider 6*a* is slid backward (to the box pin 4 side) along the row 3 of elements of the right fastener stringer 2*a*, and is moved to a position (an insert-pin inserting position) where the shoulder opening side of the first slider 6*a* is brought into contact with the stopper portion 42 of the box pin 4.

At this time, first, the suppressing portions 43 of the box pin 4 enter the element guiding path 68 of the first slider 6*a* from the shoulder opening. Further, the suppressing portions 43 pass through the element guiding path 68 and are discharged from the rear opening of the first slider 6*a*.

In this case, the suppressing portions 43 are arranged in the notched region 41*b* of the box pin body 41 having the side surface portion excluded as described above. Therefore, when the suppressing portions 43 of the box pin 4 pass through the element guiding path 68 of the first slider 6*a*, the upper surface portion and the lower surface portion of the notched region 41*b* of the box pin body 41 are easily deflected by being pressed into the core thread portions 7*a* made of fiber and by being locally dented. Accordingly, the suppressing portions 43 can be displaced to a fastener tape 7 side. With this arrangement, inconvenience that the suppressing portions 43 are hung up by the first slider 6*a* can be prevented, even when an error occurs in a size of the box pin 4 or the first slider 6*a* at a manufacturing time of the slide fastener 1, for example.

Particularly, in the first embodiment, because the curved portion 43*b* is formed on the suppressing portions 43 in a tape length direction, the suppressing portions 43 can smoothly enter the element guiding path 68 from the shoulder opening of the first slider 6*a* without being hung up by the first slider 6*a*.

Next, the ridge portions 44 arranged in the body region 41*a* of the box pin 4 enter the element guiding path 68 of the first slider 6*a* from the shoulder opening. In this case, the ridge portions 44 have a semicircular shape when looked at in a cross-sectional view along a tape length direction. Therefore, the ridge portions 44 can smoothly enter the element guiding path 68 of the first slider 6*a* from the shoulder opening, without being hung up by the first slier 6*a*.

The ridge portions 44 that entered the element guiding path 68 of the first slider 6*a* relatively move toward the rear opening side of the first slider 6*a* by sliding on the plane portion 69*a* of the inner surface of the upper wing plate and the inner surface of the lower wing plate of the first slider 6*a*. Therefore, frictional force between the ridge portions 44 and the upper and lower wing plates 63, 64 increases, and resistance can be given to slide operation of the first slider 6*a*.

Figure 5:
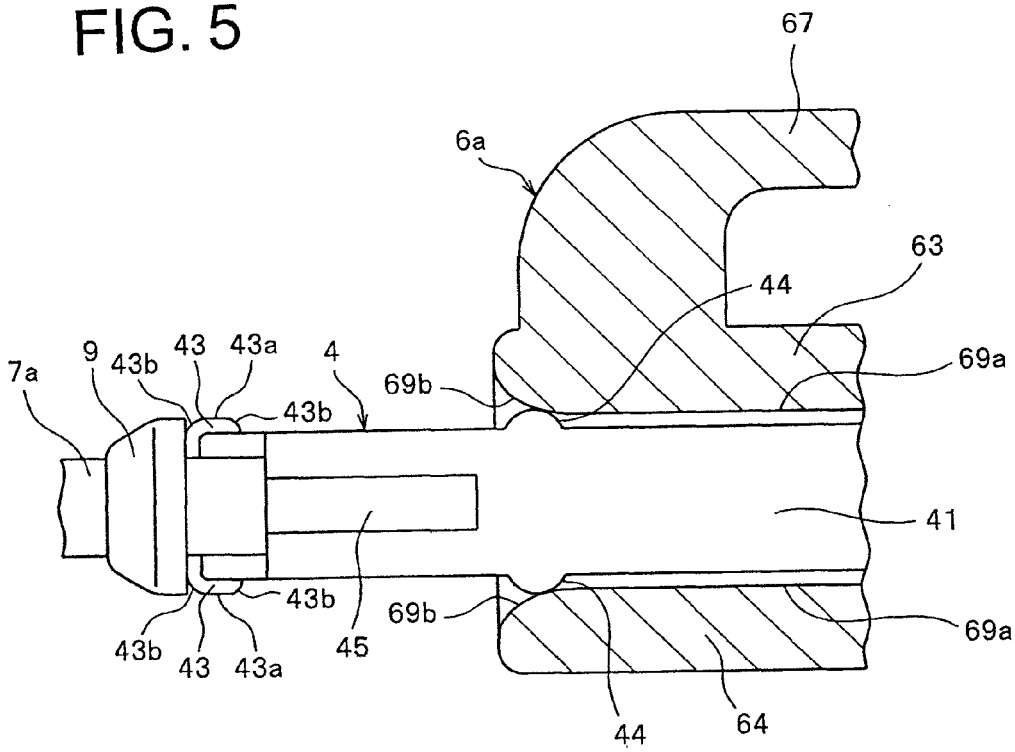
FIG. 5 is a cross-sectional view of the first slider cut along a line V-V with an arrowhead in FIG. 4.

Thereafter, the ridge portions 44 of the box pin 4 reach the chamfered portion 69*b* from the plane portion 69*a* of the inner surface of the upper wing plate and the inner surface of the lower wing plate when or immediately before the first slider 6*a* stops at the stopper portion 42, and the ridge portions 44 enter a space portion formed by the chamfered portion 69*b* in a state that the ridge portions 44 are in close contact with the chamfered portion 69*b* (see FIGS. 4 and 5). Accordingly, the first slider 6*a* can be held at a normal insert-pin inserting position.

In this case, when the ridge portions 44 of the box pin 4 moved from the plane portion 69*a* of the first slider 6*a* to the chamfered portion 69*b*, the frictional force between the ridge portions 44 and the upper and lower wing plates 63, 64 momentarily reduces. Therefore, it becomes possible to give a contact feeling of "click" to a user who slides the first slider 6*a*. With this arrangement, the user of the slide fastener 1 can confirm that the first slider 6*a* moved to the normal insert-pin inserting position.

After the first slider 6*a* is held at the insert-pin inserting position, the second slider 6*b* is slid backward (toward a box pin 4 side), and the second slider 6*b* is stopped at the insert-pin inserting position by bringing the second slider into contact with the rear-opening-side end portion of the first slider 6*a*.

At this time, the suppressing portions 43 arranged on the box pin 4 enter the element guiding path 68 from the rear opening of the second slider 6*b*. Because the curved portion 43*b* is formed on the suppressing portions 43 in a tape length direction, the suppressing portions 43 can smoothly enter the element guiding path 68 of the second slider 6*b*.

The suppressing portions 43 are arranged in the notched region 41*b* of the box pin body 41. Further, a size in a vertical direction between the crest portions of the suppressing portions 43 formed on the upper and lower surfaces of the box pin body 41 is set slightly larger than a distance between the inner surfaces of the upper and lower wing plates 63, 64 of the second slider 6*b*.

Therefore, even when there is an error in a size of the box pin 4 or the second slider 6*b* at a manufacturing time of the slide fastener 1, for example, the suppressing portions 43 can be stably slid on the inner surfaces of the upper and lower wing plates 63, 64 of the second slider 6*b* by using elastic force in the notched region 41*b* of the box pin body 41 when the suppressing portions 43 of the box pin 4 pass through the element guiding path 68 of the second slider 6*b*.

Figure 7:
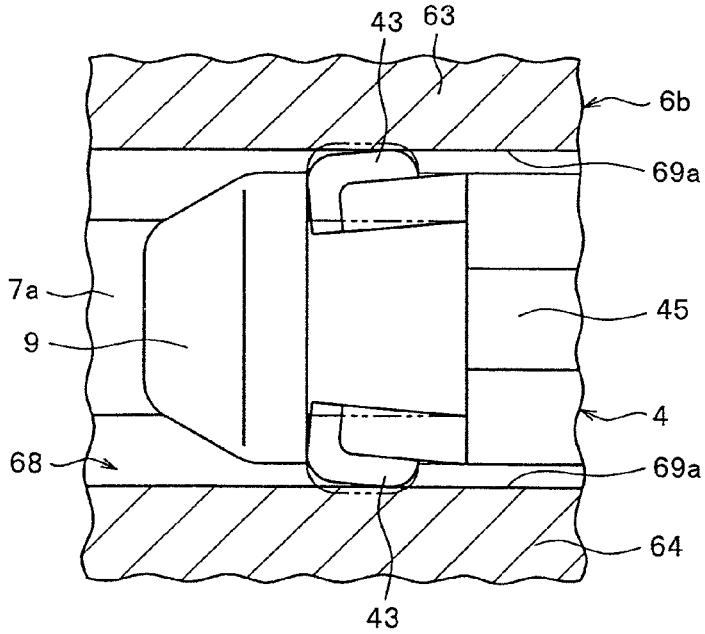
FIG. 7 is an enlarged cross-sectional view of a suppressing portion when the second slider is held at the normal insert-pin inserting position.

On the other hand, when the suppressing portions 43 receive stress in contact with the second slider 6*b*, the upper surface and the lower surface of the notched region 41*b* of the box pin body 41 are easily deflected by being pressed into the core thread portions 7*a*, as shown in FIG. 7, the suppressing portions 43 are displaced to a fastener tape 7 side. Therefore, occurrence of inconvenience that the suppressing portions 43 are hung up by the second slider 6*b* by being interfered with by the second slider 6*b* can be prevented.

Further, when the second slider 6*b* stops at the insert-pin inserting position by being brought into contact with the first slider 6*a*, the suppressing portions 43 generate frictional force between the second slider 6*b* and the suppressing portions 43 in contact with the inner surfaces of the upper and lower wing plates 63, 64 of the second slider 6*b*. Therefore, the second slider 6*b* can be stably held at the normal insert-pin inserting position (see FIGS. 6 and 7).

Figure 6:
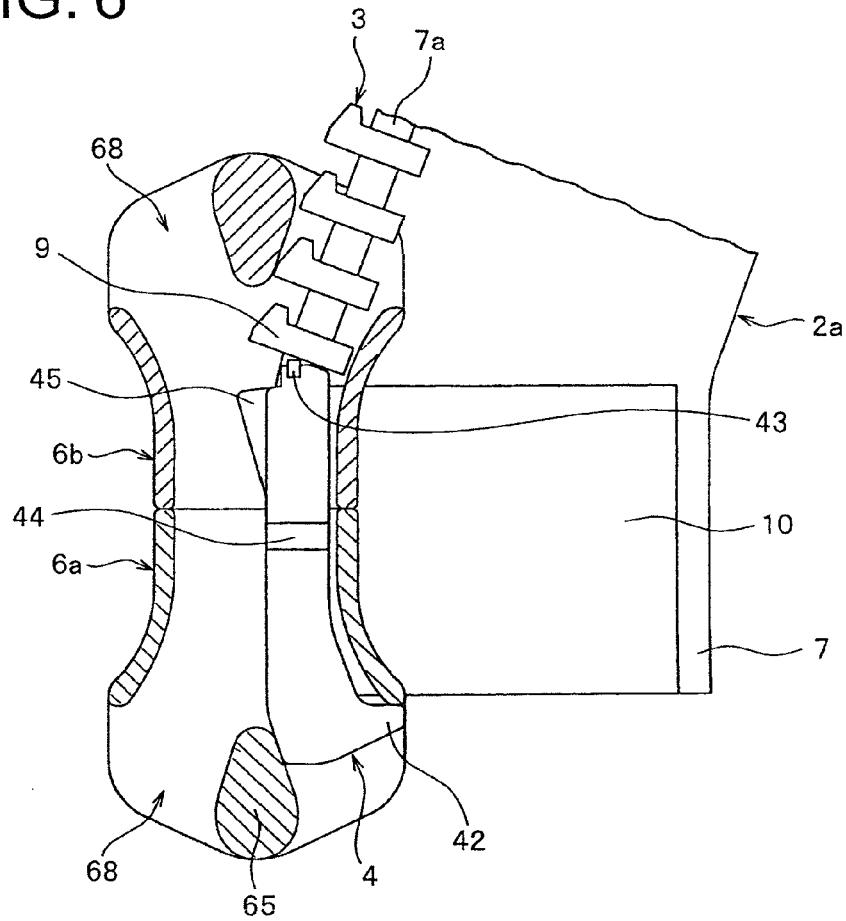
FIG. 6 is an explanatory diagram of a state that first and second sliders are held at normal insert-pin inserting positions.

When the second slider 6*b* is brought into contact with the first slider 6*a* by sliding the second slider 6*b* to the insert-pin inserting position as described above, the row 3 of elements are curved to a right side of the box pin 4 along the element guiding path 68 of the second slider 6*b* as shown in FIG. 6, for example. In this case, in the first embodiment, the suppressing portions 43 are brought into contact with the first fastener element 9 of the row 3 of elements by being extended to a front-end surface side of the box pin body 41 as described above, and the first fastener element 9 and the front end surface of the box pin body 41 are arranged separately from each other.

Therefore, the first fastener element 9 of the first embodiment can have a posture more freely inclined to the box pin body 41, as compared with the case where the first fastener element is in contact with the entire front end surface of the box pin body, for example. Accordingly, the row 3 of elements can be easily curved along the element guiding path 68 of the second slider 6*b*. Consequently, inclination of the posture of the second slider 6*b* at the insert-pin inserting position can be prevented. Further, slidability of the second slider 6*b* when sliding the second slider 6*b* from the insert-pin inserting position forward (to an element-row engagement direction) can be improved.

Figure 8:
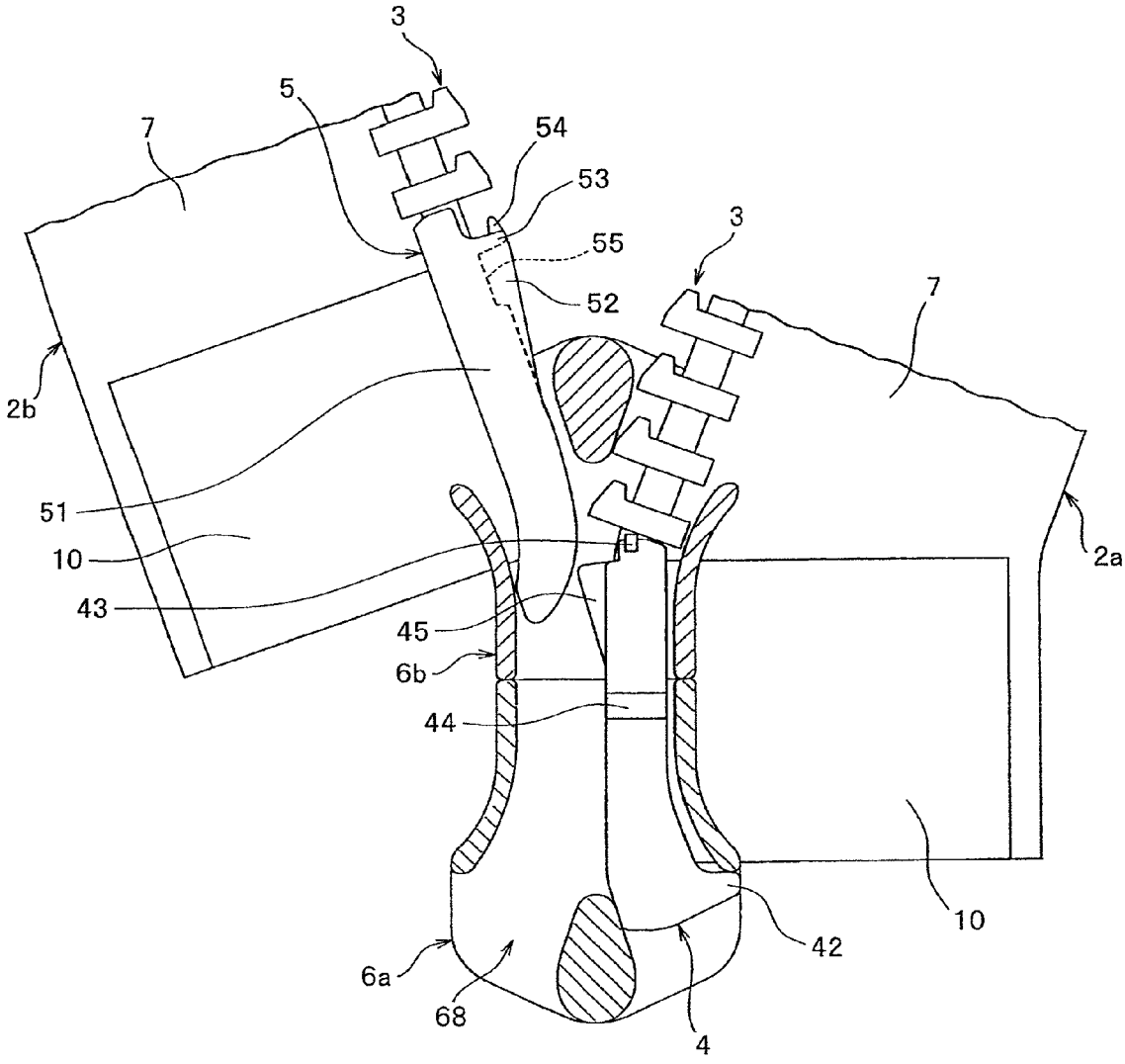
FIG. 8 is an explanatory diagram of operation of inserting the insert pin into the first and second sliders.

As shown in FIG. 8, the insert pin 5 is inserted into the element guiding path 68 of the second slider 6*b* and the element guiding path 68 of the first slider 6*a* from the shoulder opening of the second slider 6*b*. At this time, the first and second sliders 6*a*, 6*b* are stably held at the normal insert-pin inserting positions as described above.

Figure 9:
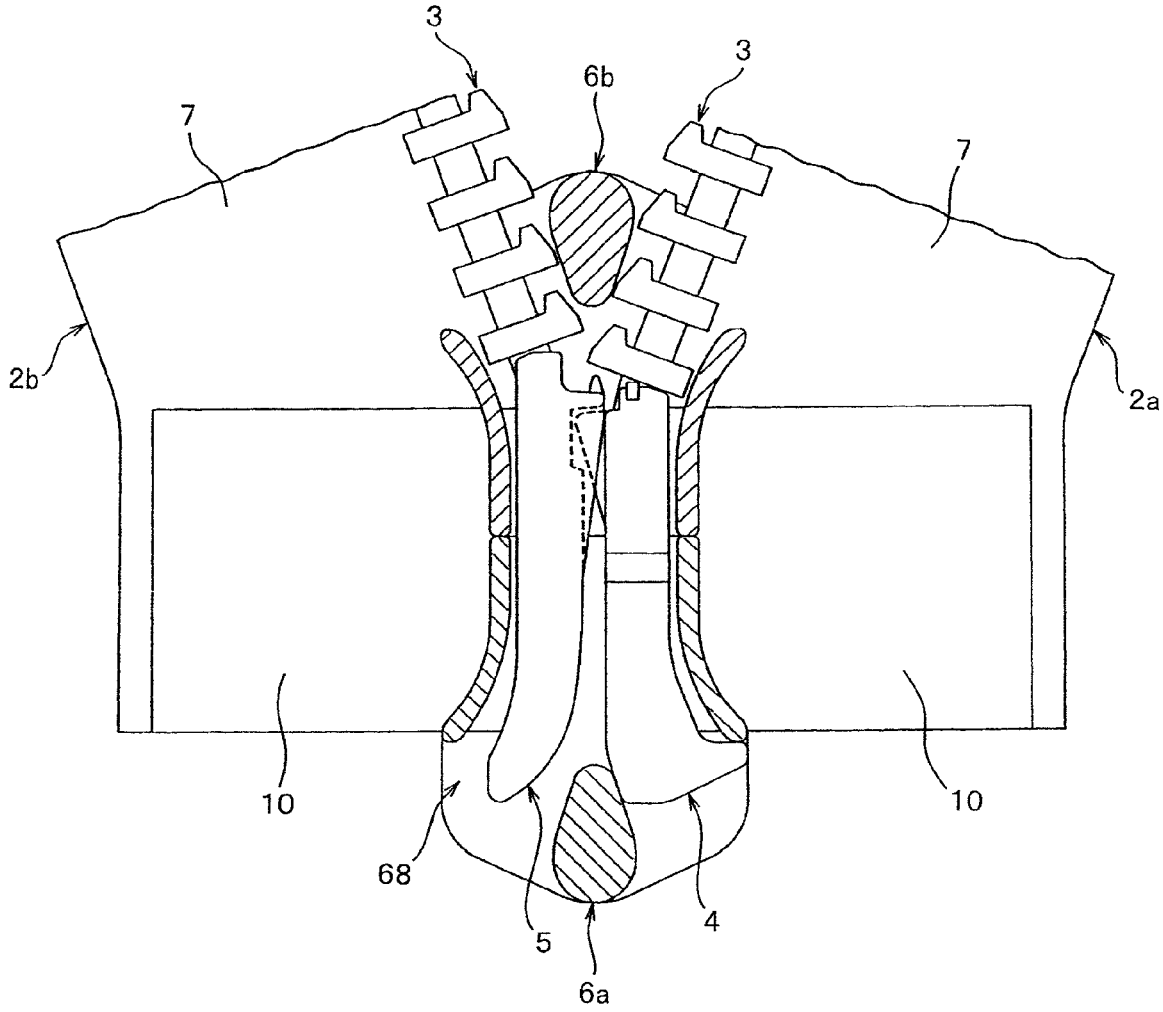
FIG. 9 is an explanatory diagram showing a state that the insert pin is inserted into the first and second sliders.

Therefore, the insert pin 5 can be smoothly and stably inserted to a position where the second locking piece 53 of the insert pin 5 is brought into contact with the first locking piece 45 of the box pin 4 without being hung up by the row 3 of elements of the right fastener stringer 2*a* and the box pin 4 along the way (see FIG. 9).

Figure 10:
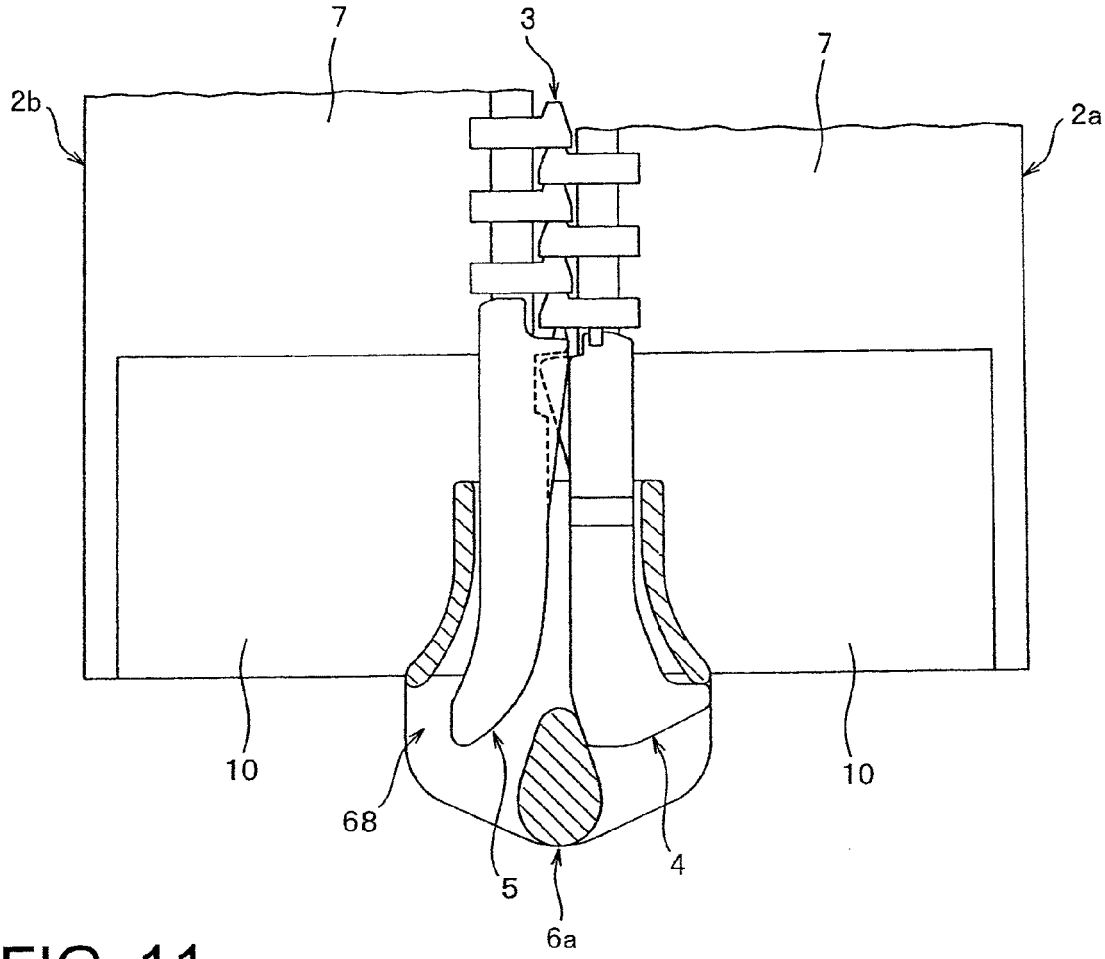
FIG. 10 is an explanatory diagram showing a state that left and right rows of elements are engaged together by sliding the second slider forward.

Thereafter, the second slider 6*b* is slid forward along the row 3 of elements from a state of FIG. 9. As a result, the left and right rows 3 of elements can be engaged, and the left fastener stringer 2*b* and the right fastener stringer 2*a* can be smoothly and stably closed together (see FIG. 10).

Further, thereafter, the first slider 6*a* held at the insert-pin inserting position (the tail end position at the box pin 4 side) is slid forward along the row 3 of elements. As a result, the right and left fastener stringers 2*a*, 2*b* that are closed together can be easily opened from the end portion (the rear end portion) of the box pin 4 and the insert pin 5 as shown in FIG. 1.

Next, a case of opening the left fastener stringer 2*b* and the right fastener stringer 2*a* by completely separating the fastener stringers from a state that the right and left fastener stringers 2*a*, 2*b* are reversely opened as shown in FIG. 1 is explained.

First, the first slider 6*a* is slid backward along the row 3 of elements, and the first slider 6*a* is moved to the insert-pin inserting position where the first slider 6*a* is brought into contact with the stopper portion 42 of the box pin 4 by engaging the left and right rows 3 of elements. At this time, the suppressing portions 43 of the box pin 4 pass through the element guiding path 68 by sliding on the inner surfaces of the upper and lower wing plates 63, 64 from the shoulder opening of the first slider 6*a*, and are discharged from the rear opening of the first slider 6*a*, without generating inconvenience that the suppressing portions 43 are hung up by the first slider 6*a*.

Next, the ridge portions 44 of the box pin 4 enter the element guiding path 68 from the shoulder opening of the first slider 6*a*, and relatively move toward the rear opening side by sliding on the plane portion 69*a* of the inner surface of the upper wing plate 63. Further, the ridge portions 44 reach the chamfered portion 69*b* from the plane portion 69*a* of the upper and lower wing plates 63, 64, and are brought into close contact with the chamfered portion 69*b* when or immediately before the first slider 6*a* stops at the stopper portion 42. Accordingly, slide of the first slider 6*a* can be suppressed, and a state that the first slider 6*a* is in contact with the stopper portion 42 can be stably held.

Next, the second slider 6*b* is slid backward. Accordingly, the left and right rows of elements in the engaged state are separated from each other, and the second slider 6*b* is stopped at a position (the insert-pin inserting position) where the second slider 6*b* is brought into contact with the end portion of the rear opening of the first slider 6*a*. At this time, the suppressing portions 43 of the box pin 4 are pressed against the inner surfaces of the upper and lower wing plates 63, 64 of the second slider 6*b* without generating inconvenience of being hung up by the second slider 6*b*. Therefore, frictional force is generated between the ridge portions 44 and the upper and lower wing plates 63, 64 of the second slider 6*b*, and the second slider 6*b* can be held at the insert-pin inserting position.

Thereafter, the insert pin 5 is extracted from the element guiding paths 68 of the first and second sliders 6*a*, 6*b*. At this time, because the first and second sliders 6*a*, 6*b* are held at the respective insert-pin inserting positions, the insert pin 5 can be smoothly and stably extracted. Accordingly, the left fastener stringer 2*b* and the right fastener stringer 2*a* can be smoothly and stably opened.

Because the slide fastener 1 according to the first embodiment is configured as described above, even when a variation occurs in a size of the box pin 4 and the first and second sliders 6*a*, 6*b*, the suppressing portion 43 can be displaced to the fastener tape 7 side by easily elastically deforming the upper surface portion and the lower surface portion of the notched region 41*b* of the box pin body 41 in a vertical direction. Therefore, reduction of slidability and operability of the sliders due to hung up of the suppressing portions 43 by the first and second sliders 6*a*, 6*b* can be prevented.

When the suppressing portions 43 enter the element guiding path 68 of the second slider 6*b*, the suppressing portions 43 can be stably slid on the inner surfaces of the upper and lower wing plates 63, 64 of the second slider 6*b* by using elastic force of the notched region 41*b* of the box pin body 41. Therefore, when the second slider 6*b* moves to the insert-pin inserting position and stops there, the second slider 6*b* can be stably held at this insert-pin inserting position. Consequently, the left and right fastener stingers 2 can be easily opened and closed subsequently by smoothly performing an insert operation or an extract operation of the insert pin.

In the first embodiment, a case where the ridge portions 44 having a semicircular cross section in the box pin 4 are formed at predetermined positions of the first slider 6*a* is explained. However, in the invention, a layout position and a mode of the ridge portions 44 are not particularly limited.

Figure 11:
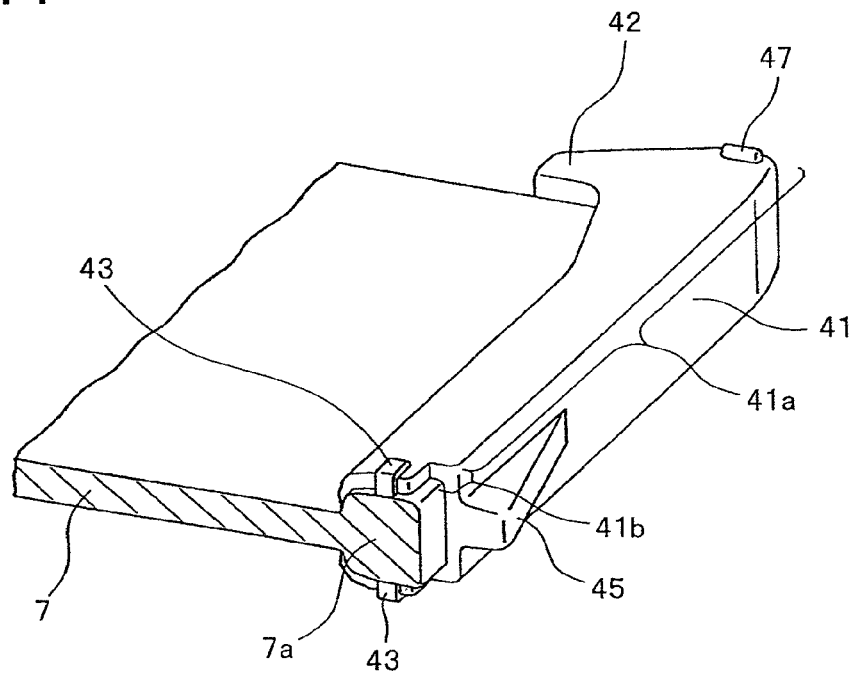
FIG. 11 is a perspective view of a box pin according to a modification of the first embodiment.
Figure 12:
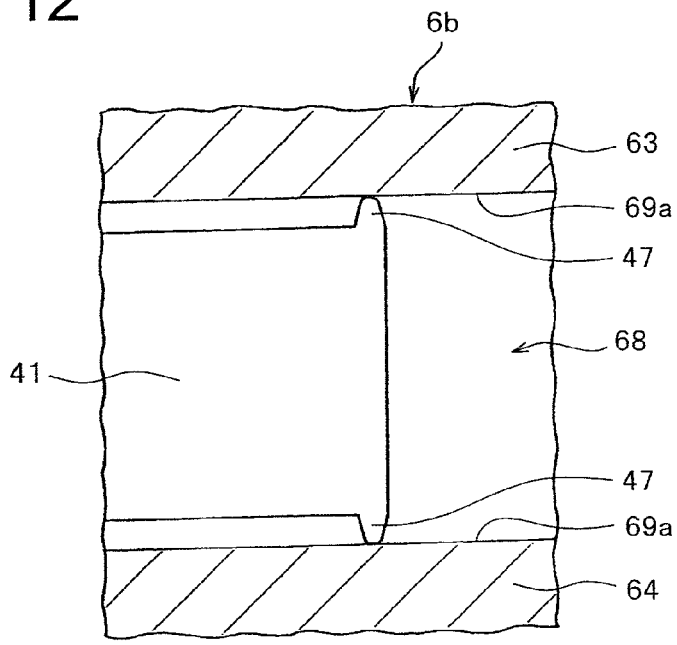
FIG. 12 is an enlarged cross-sectional view showing a state that the first slider is held at an insert-pin inserting position according to a modification of the first embodiment.

For example, in the invention, as a modification of the first embodiment is shown in FIGS. 11 and 12, ridge portions 47 can be formed small at a front end portion of the box pin body 41. In this case, a size in a vertical direction from a crest portion of a ridge portion 47 formed on the upper surface side of the box pin body 41 to a crest portion of a ridge portion 47 formed at a lower surface side of the box pin body 41 is set slightly larger than a distance between the plane portion 69*a* of the upper wing plate 63 and the plane portion 69*a* of the lower wing plate 64 of the first slider 6*a*.

Therefore, when the ridge portions 47 enter the element guiding path 68 of the first slider 6*a*, the ridge portions 47 at an upper surface side and a lower surface side arranged on the box pin body 41 generate frictional force by sliding on the plane portions 69*a* of the upper wing plate 63 and the lower wing plate 64 of the first slider 6*a*. Accordingly, when the first slider 6*a* moved to the insert-pin inserting position, the first slider 6*a* can be stably held at this position by using the frictional force between the ridge portions 47 and the first slider 6*a*.

Figure 13:
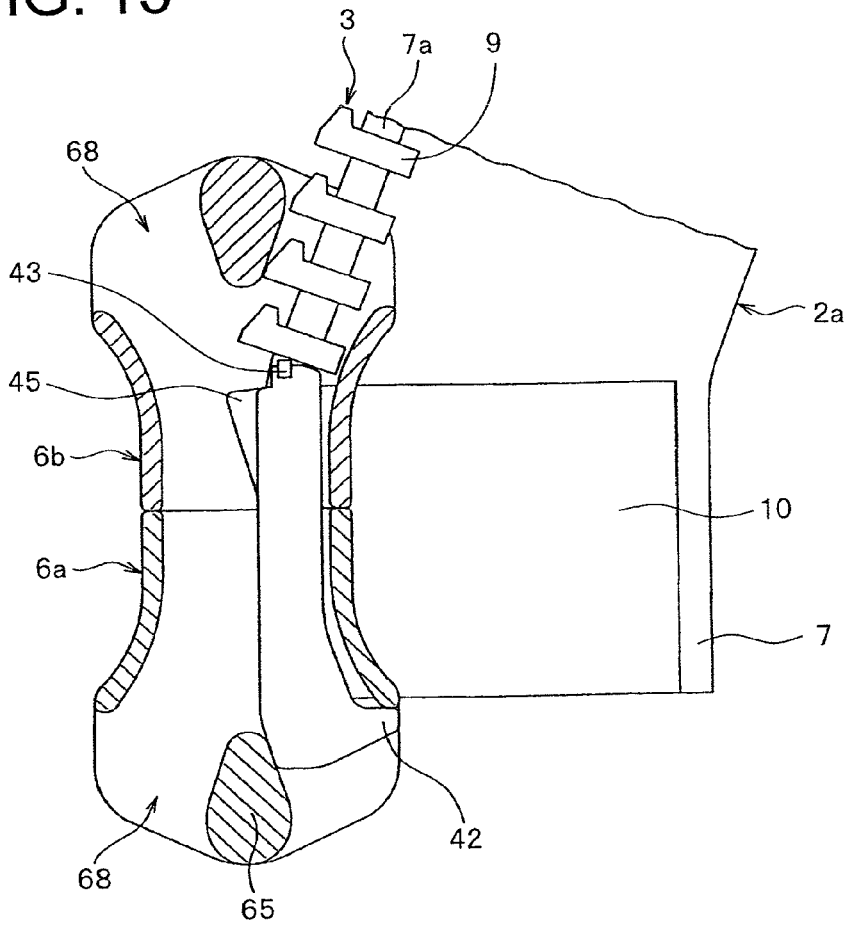
FIG. 13 is a cross-sectional view of a slide fastener according to another modification of the first embodiment.

Further, in the invention, a cross-sectional shape of the ridge portions in a tape length direction can be formed in a triangular shape or a rectangular shape instead of a semicircular shape. Depending on a usage or the like of the slide fastener, the box pin 4 can be also configured without forming the ridge portions 44 as shown in FIG. 13, for example.

A layout position and a mode of the ridge portions are not limited either in a second embodiment and a third embodiment described later.

Second Embodiment

Figure 14:
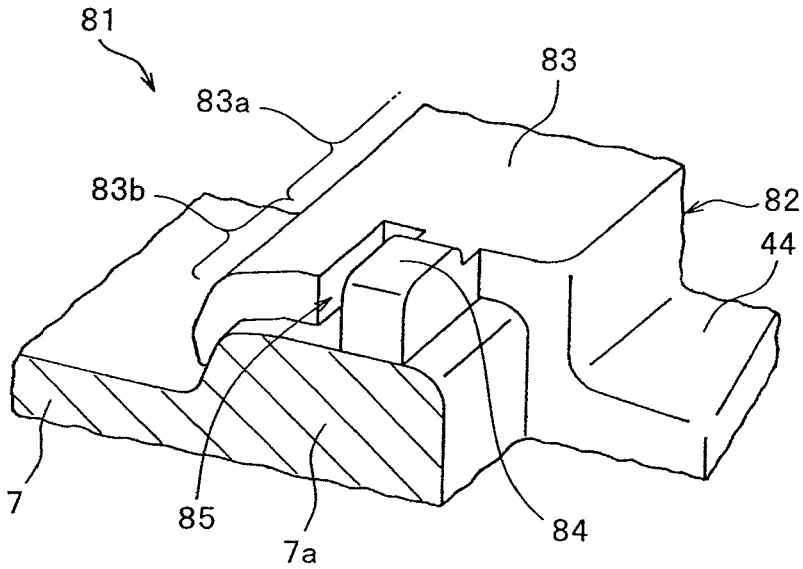
FIG. 14 is an enlarged perspective view of a part of a box pin according to a second embodiment.

FIG. 14 is an enlarged perspective view of a part of a box pin according to a second embodiment.

According to a slide fastener 81 of the second embodiment, a mode of a notched region 83*b* of a box pin body 83 and a mode of suppressing portions 84 of a box pin 82 respectively are different from those of the box pin body 41 and the suppressing portions 43 of the box pin 4 in the first embodiment.

Configurations of portions other than the notched region 83*b* and the suppressing portions 84 of the box pin body 83 in the second embodiment are basically the same as the configurations of the slide fastener 1 in the first embodiment. Therefore, portions of the slide fastener 81 in the second embodiment that have similar configurations to those of members explained in the first embodiment are indicated with the same reference numerals and their explanation is omitted.

The box pin body 83 of the second embodiment has a body region 83*a* formed to surround upper and lower surfaces of a tape-side end edge of the fastener tapes 7 and a side surface at a side opposite to the insert pin, and the notched region 83*b* arranged at an element-row-side base end portion and having excluded a side surface portion of the box pin body 83 at a side facing the insert pin.

On the upper surface portion and the lower surface portion of the notched region 83*b* of the box pin body 83, a portion further at a side facing the insert pin 5 than the suppressing portions 84 is cut out also. A side surface of the suppressing portions 84 at a side facing the insert pin and a side surface of the notched region 83*b* of the box pin body 83 at an insert-pin opposite aide are formed on the same plane.

Further, slits 85 are formed along the suppressing portions 84 in a tape length direction at a tape inner side than the suppressing portions 84, in the notched region 83*b* of the box pin body 83. By providing the slits 85, a portion of the box pin body 83 where the suppressing portions 84 are projected can be more easily deflected in a vertical direction. Therefore, the suppressing portions 84 can be more easily displaced to a fastener tape 7 side.

Because the slide fastener 81 of the second embodiment is configured in this way, the suppressing portions 84 can be more easily displaced to the fastener tape 7 side even when a variation occurs in a size of the box pin 4 and the first and second sliders 6*a*, 6*b*. Therefore, occurrence of inconvenience that the suppressing portions 43 are hung up by the first and second sliders 6*a*, 6*b* can be securely prevented.

The suppressing portions 84 can be stably slid in contact on the inner surfaces of the upper and lower wing plates 63, 64 of the second slider 6*b* by using elastic force and the like of the box pin body 83 when the suppressing portions 84 enter the element guiding path 68 of the second slider 6*b*. Therefore, when the second slider 6*b* moves to the insert-pin inserting position and stops there, the second slider 6*b* can be stably held at this insert-pin inserting position.

Third Embodiment

Figure 15:
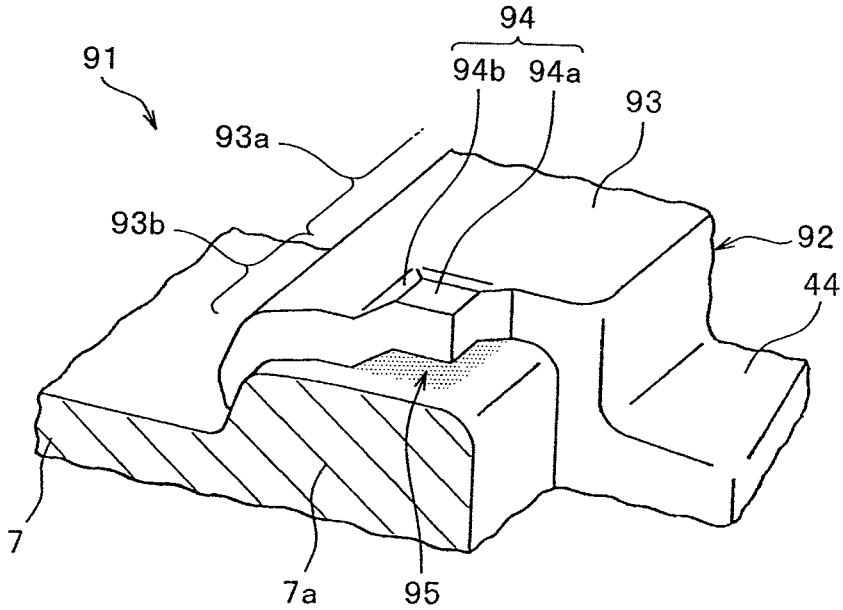
FIG. 15 is an enlarged perspective view of a part of a box pin according to a third embodiment.
Figure 16:
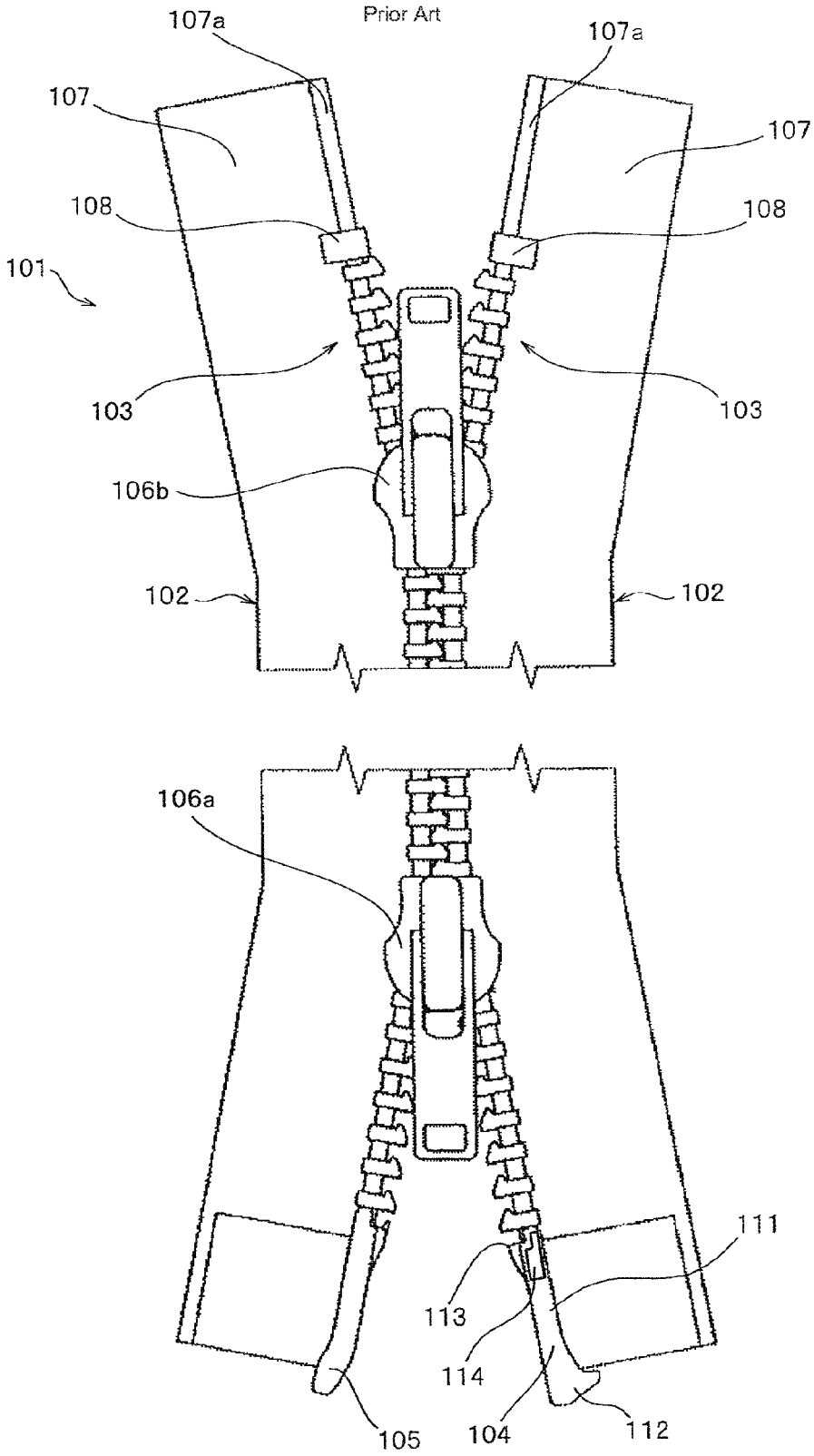
FIG. 16 Prior Art
FIG. 16 is a partly-omitted front view of a conventional reverse-opening slide fastener.
Figure 17:
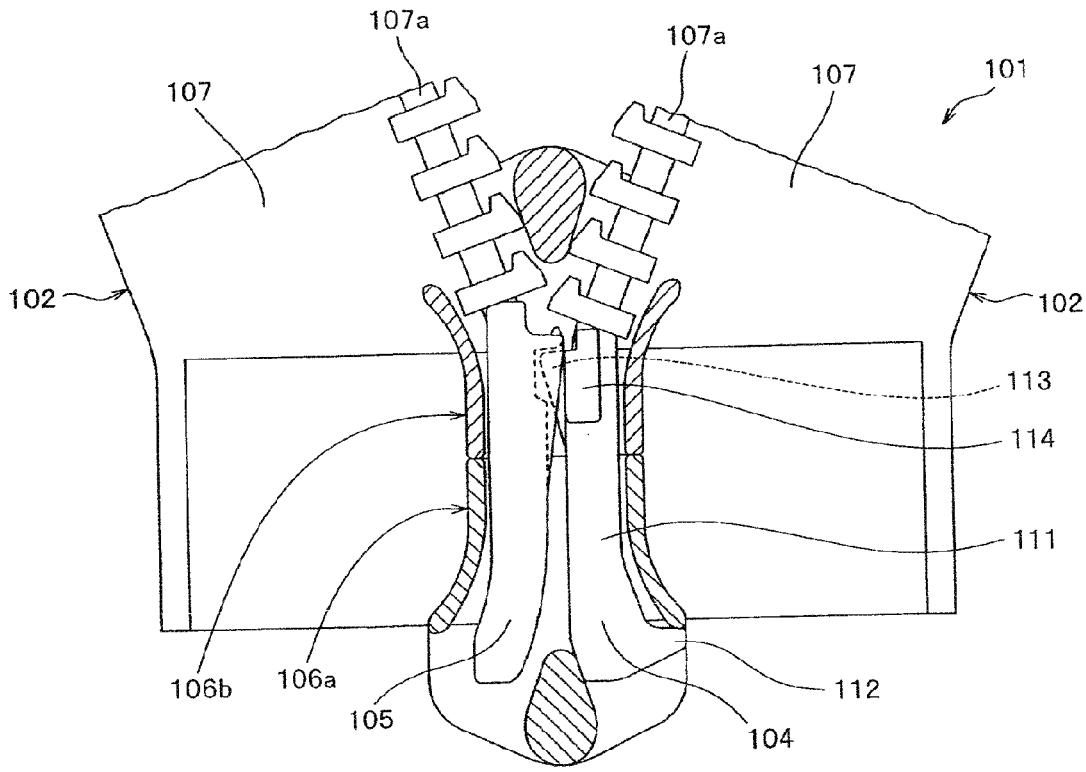
FIG. 17 Prior Art
FIG. 17 is a cross-sectional view of a main portion of a conventional slide fastener.

FIG. 15 is an enlarged perspective view of a part of a box pin according to a third embodiment.

According to a slide fastener 91 of the third embodiment, a mode of a notched region 93*b* of a box pin body 93 and a mode of suppressing portions 94 of a box pin 92 respectively are different from those of the first embodiment. Other portions have basically the same configurations as those of the slide fastener 1 of the first embodiment.

The box pin body 93 of the third embodiment have a body region 93*a* formed to surround upper and lower surfaces of a tape-side end edge of the fastener tapes 7 and a side surface at a side opposite to the insert pin, and a notched region 93*b* arranged at an element-row-side base end portion and having excluded a side surface portion of the box pin body 93 at a side facing the insert pin.

On the upper surface portion and the lower surface portion of the notched region 93*b* of the box pin body 93, a portion further at a side facing the insert pin 5 than the suppressing portions 94 is cut out also. A region of the box pin body 93 where the suppressing portions 94 are formed at an upper surface side and a lower surface side is formed to be partially raised such that this region is separated from the core thread portions 7*a* of the fastener tapes 7. Therefore, a gap 95 is formed between a rear surface of the upper surface portion and a rear surface of the lower surface portion of the box pin body 93 and the core thread portions 7*a* of the fastener tapes 7.

The suppressing portions 94 are projected on the upper surface portion and the lower surface portion of the box pin body 93, and crest portions 94*a* of the suppressing portions 94 are formed to have a rectangular shape in a front view. The suppressing portions 94 have inclined portions 94*b* for gradually reducing a height of projection from the crest portions 94*a* backward and toward a tape inner side.

Because the slide fastener 91 of the third embodiment is configured in this way, even when a variation occurs in a size of the box pin 92 and the first and second sliders 6*a*, 6*b*, the suppressing portions 94 can be easily displaced to a fastener tape 7 side in a similar manner to that of the first and second embodiments. Particularly, in the third embodiment, because the gap 95 is formed between the rear surface of the upper surface portion and the rear surface of the lower surface portion of the box pin body 93 and the core thread portions 7*a* as described above in the region where the suppressing portions 94 of the box pin body 93 are formed, the suppressing portions 94 can be more easily displaced toward the gap 95. With this arrangement, reduction of slidability and operability of the sliders due to hung up of the suppressing portions 94 by the first and second sliders 6*a*, 6*b* can be more securely prevented.

When the second slider 6*b* moves to the insert-pin inserting position and stops there, the second slider 6*b* can be stably held at the insert-pin inserting position by using frictional force between the suppressing portions 94 and the second slider 6*b*.

Further, in the third embodiment, because the inclined portions 94*b* are formed on the suppressing portions 94, the suppressing portions 94 can be entered more smoothly when smoothly entering the suppressing portions 94 in the element guiding path 68 of the first slider 6*a* or the second slider 6*b*.

Explanation of Reference Numerals

| | |
|---|---|
| 1 | Slide fastener |
| 2 | Fastener stringer |
| 2a | Right fastener stringer |
| 2b | Left fastener stringer |
| 3 | Row of elements |
| 4 | Box pin |
| 5 | Insert pin |
| 6a | First slider |
| 6b | Second slider |
| 7 | Fastener tape |
| 7a | Core thread portion |
| 8 | Stopper |
| 9 | Fastener element |
| 10 | Reinforcing portion |
| 41 | Box pin body |
| 41a | Body region |
| 41b | Notched region |
| 42 | Stopper portion |
| 43 | Suppressing portion |
| 43a | Crest portion |
| 43b | Curved portion |
| 44 | Ridge portion |
| 45 | First locking piece |
| 47 | Ridge portion |
| 51 | Insert pin body |
| 52 | Guiding piece |
| 53 | Second locking piece |
| 54 | Projecting portion |
| 55 | Escape trench |
| 61 | Slider body |
| 62 | Tab |
| 63 | Upper wing plate |
| 64 | Lower wing plate |
| 65 | Coupling post |
| 66 | Flange |
| 67 | Tab attaching post |
| 68 | Element guiding path |
| 69a | Plane portion |
| 69b | Chamfered portion |
| 81 | Slide fastener |
| 82 | Box pin |
| 83 | Box pin body |

-continued

| | |
|---|---|
| 83a | Body region |
| 83b | Notched region |
| 84 | Suppressing portion |
| 85 | Slit |
| 91 | Slide fastener |
| 92 | Box pin |
| 93 | Box pin body |
| 93a | Body region |
| 93b | Notched region |
| 94 | Suppressing portion |
| 94a | Crest portion |
| 94b | Inclined portion |
| 95 | Gap |

The invention claimed is:

1. A slide fastener capable of performing an open/insert operation, comprising:

a pair of first and second fastener stringers having rows of elements at opposite tape-side edge portions of first and second fastener tapes, a box pin extended from an end of the row of elements of the first fastener stringer, an insert pin extended from an end of the row of elements of the second fastener stringer, and a pair of first and second sliders slidably arranged along the rows of elements, wherein the first slider is arranged closer to the box pin than the second slider in a direction to which rear openings of the first and second sliders face each other, the box pin has a box pin body fixed to the first fastener tape, a stopper portion arranged at a front end side of the box pin body for stopping the first slider, and at least one suppressing portion projected on at least one of upper and lower surfaces of the box pin body to suppress sliding of the second slider by closely contacting an inner surface of a slider body of the second slider, the box pin body has a body region that surrounds upper and lower surfaces of a tape-side end edge of the first fastener tape and a side surface at a side opposite to the insert pin, and a notched region arranged at an element-row-side base end portion that excludes a side surface portion at a side facing the insert pin, and the suppressing portion is projected in the notched region of the box pin body.

2. The slide fastener according to claim 1, wherein the suppressing portions has a crest portion having a largest height of projection from the upper surface or the lower surface of the box pin body, and an inclined portion or a curved portion gradually reducing the height of projection from the crest portion in a tape length direction.

3. The slide fastener according to claim 1, wherein the box pin body has at least one slit formed in a tape length direction along the suppressing portion at a tape inner side of the suppressing portion.

4. The slide fastener according to claim 1, wherein the box pin has at least one ridge portion projected on at least one of upper and lower surfaces of the box pin body for closely contacting with an inner surface of the slider body of the first slider, at a position closer to a front end side of the box pin than the suppressing portion.

* * * * *

UNITED STATES PATENT AND TRADEMARK OFFICE

CERTIFICATE OF CORRECTION

PATENT NO. : 8,661,628 B2
APPLICATION NO. : 13/387765
DATED : March 4, 2014
INVENTOR(S) : Keiichi Keyaki et al.

It is certified that error appears in the above-identified patent and that said Letters Patent is hereby corrected as shown below:

In the Claims

In column 18, line 12, In Claim 1, after "in" insert -- only --.

Signed and Sealed this
First Day of July, 2014

Michelle K. Lee

Michelle K. Lee
*Deputy Director of the United States Patent and Trademark Office*